US005116714A

United States Patent [19]

Watanabe et al.

[11] Patent Number: 5,116,714

[45] Date of Patent: May 26, 1992

[54] IMAGE FORMING MATERIAL WITH DEVELOPER AND PHOTOSENSITIVE BASE ON WHICH AN ELECTROSTATIC LATENT IMAGE IS FORMED

[75] Inventors: Haruo Watanabe, Kanagawa; Akio Yasuda, Tokyo; Koichi Kawasumi; Takao Tsuchiya, both of Kanagawa; Kiyosuke Suzuki, Saitama, all of Japan

[73] Assignee: Sony Corporation, Tokyo, Japan

[21] Appl. No.: 475,272

[22] Filed: Feb. 5, 1990

[30] Foreign Application Priority Data

Feb. 6, 1989 [JP] Japan ..... 1-25921

[51] Int. Cl.[5] ..... G03G 9/08; G03G 13/10; G03G 15/10

[52] U.S. Cl. ..... 430/117; 354/317; 355/211; 355/256; 430/56; 430/209

[58] Field of Search ..... 354/303, 317, 318; 355/256, 210, 211; 430/56, 104, 112, 117, 208, 209

[56] References Cited

U.S. PATENT DOCUMENTS

| | | | |
|---|---|---|---|
| 3,345,172 | 10/1967 | Land | 354/317 X |
| 3,431,890 | 3/1969 | Ulary | 355/256 X |
| 3,556,784 | 1/1971 | Robinson et al. | 355/256 X |
| 3,697,172 | 10/1972 | Ohta et al. | 355/220 X |
| 3,763,754 | 10/1973 | Harvey | 354/303 |
| 4,189,226 | 2/1980 | Yamaguchi et al. | 355/256 |
| 4,236,806 | 12/1980 | Hoddley | 354/303 |
| 4,273,852 | 6/1981 | Lange et al. | 354/303 X |
| 4,392,734 | 7/1983 | Plumadore | 354/317 X |

*Primary Examiner*—Fred L. Braun

*Attorney, Agent, or Firm*—Hill, Van Santen, Steadman & Simpson

[57] ABSTRACT

An image forming material is provided in which a developer container containing a developer consisting of an electrically insulating organic material which is solid at ambient temperature and which may be liquefied on heating, and wherein colorant particles are dispersed in the material, is made as one with a photosensitive base on which to form an electrostatic latent image. With such image forming material, the developer required in the developing process is incorporated in the photosensitive base to permit image formation and storage by the electrophotographic process to be performed as easily as in so-called instant photography. When the outer size of the image forming material or that of the separated photosensitive base is of the 35 mm format slide size, the imaging material or the base may be attached directly to a slide projector or the like to permit the image information to be easily seen.

19 Claims, 5 Drawing Sheets

IMAGE FORMING MATERIAL WITH DEVELOPER AND PHOTOSENSITIVE BASE ON WHICH AN ELECTROSTATIC LATENT IMAGE IS FORMED

BACKGROUND OF THE INVENTION

1. Field of the Invention

This invention relates to an imaging or image forming material which enables image formation and storage by the electrophotographic process based on the electrostatic latent image to be performed by a simple operation comparable to that for instant photography.

2. Prior Art

In the field of image forming technique, a system in which a uniformly charged photosensitive member is selectively irradiated with light in accordance with image signals, and wherein the electrostatic image thus formed is developed, is generally termed an electrophotographic process. This electrophotographic process is roughly classified into a dry developing method and a wet developing method.

The wet developing method means a system in which an electrostatic latent image formed on a photosensitive member is developed using a liquid developer produced by dispersing the dye or the pigment as the colorant in the form of fine powders in an insulating medium. Research and development is currently conducted in various phases of the wet developing method since the resolution and the gradation comparable with that of the halide photograph may be achieved, and wherein the image exhibits superior weatherability, particularly when the pigment is used as the colorant.

The majority of the liquid developers for wet development now being evolved are a liquid developer making use of a substance which is liquid at room temperature and which is represented by a saturated hydrocarbon insulating medium such as Isopar G manufactured by ESSO. However, this liquid developer has a drawback such that it is inferior in handling properties and operability, while being insufficient in image reproducibility due to susceptibility of the colorant particles to flocculation and precipitation, and that a separate step of waste liquid disposal is necessitated.

For overcoming the above problem, the present Applicant has proposed in the Japanese Patent Application 63-156846 (1988) an electrostatic latent image developer which is produced by dispersing colorant particles in an electrically insulating organic material which is solid at ambient temperature.

Meanwhile, the above mentioned electrostatic latent image developer is markedly superior to the liquid developer in operability or handling/storage properties, and is usually contained in a developer tank in the state of being ready for usage. However, there is still ample room for simplifying or reducing the size of the device for development or shortening the developing time with respect to application of the developer.

For practical usage, it is desirable that the developed electrostatic latent image be recorded and stored in a directly visible form. Although the latent image is conventionally transferred to a suitable transfer medium, such as paper, the transfer efficiency is lowered due to too strong adsorption between the colorant particles and the photosensitive member, which lowers the image quality.

OBJECT AND SUMMARY OF THE INVENTION

It is therefor an object of the present invention to provide a novel image forming material which may be handled easily and which is able to form a high-quality image at high speed and with high reproducibility.

It is another object of the present invention to provide an image forming material which may be directly attached to, for example, a slide projector to enable an image to be seen easily.

The present invention is proposed for accomplishing the above objects.

The image forming material of the present invention is characterized in that a developer container containing a developer composed of colorants dispersed in an electrically insulating organic substance which is solid at ambient temperature is made as one with a photosensitive base on which is formed an electrostatic latent image to be developed by the above developer. A size of the photosensitive base is of a 35 mm format slide size.

The developer employed in the present invention is comprised of an electrically insulating organic substance which is solid at ambient temperature and in which colorants are dispersed uniformly. The developer, which is maintained by suitable heating means at the time of usage in the molten state, remains solid except at the time of usage, and hence is superior in handling and storage properties and in the aspects of environmental protection.

The image forming material of the present invention consists in the photosensitive base for forming an electrostatic latent image developed by the developer, and a developer container formed as one with the photosensitive base. With such an arrangement, there is no necessity of providing a large size vessel, such as a developer tank, for containing a developer on the outside, or transporting the photosensitive base, on which the electrostatic latent image has been formed, to the site of the developer tank, for example, to perform the developing operation. This simplifies the overall device, while realizing space saving. In addition, an amount of the developer which is necessary and sufficient for developing an image is stored in the hermetically-sealed state and discarded after each developing operation. However, there is no necessity to prepare the developer for each developing operation when there is no risk of the developer undergoing temporal changes in its composition.

Thus the high-quality image may be produced at a high speed and with good reproducibility.

In addition, with the image forming material of the present invention, direct attachment to a slide projector or the like may be enabled by the outer size of the image forming material or the outer size of the separated photosensitive base being of the 35 mm format slide size.

BRIEF DESCRIPTION OF THE DRAWINGS

FIGS. 3A to 3D are diagrammatic cross-sectional views sequentially showing the steps of actual image forming with the use of the image forming material of the present invention, wherein FIG. 3A shows the corona charging step. FIG. 3B shows the step of forming an electrostatic latent image by light exposure, FIG. 3C shows the developing step and FIG. 3D shows the developer discharging step.

DESCRIPTION OF THE PREFERRED EMBODIMENTS

Figure 1:
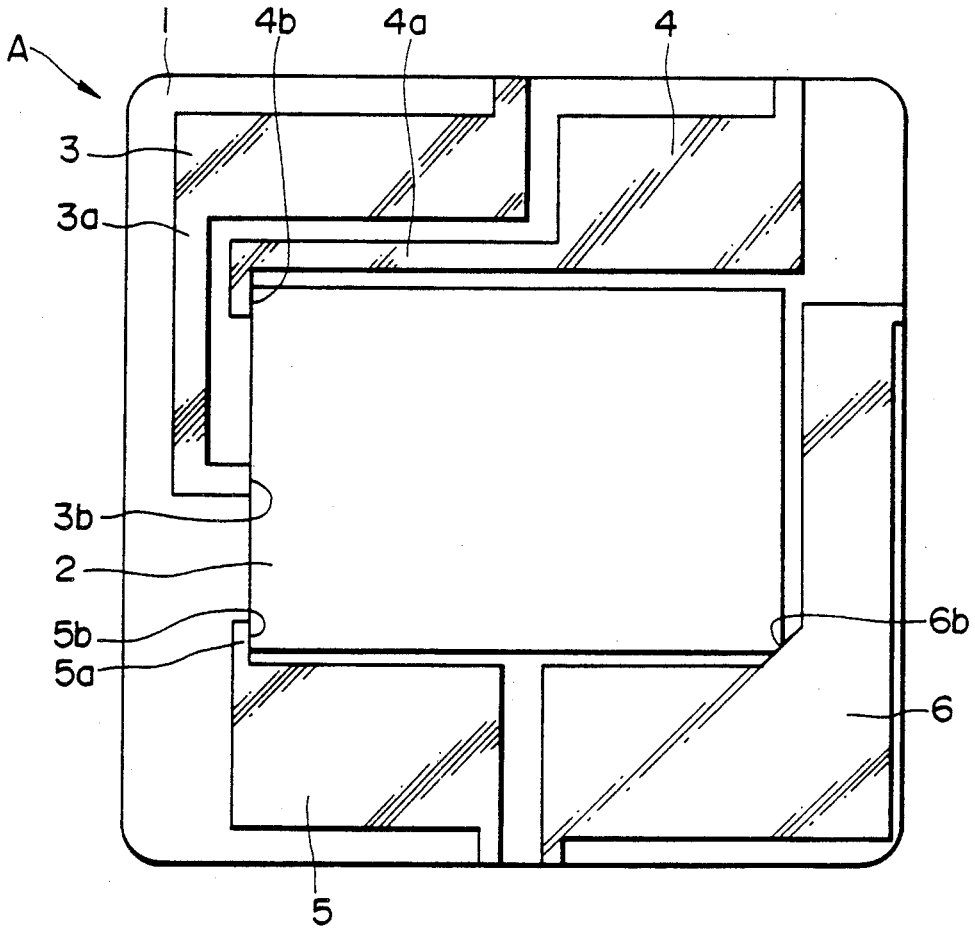
FIG. 1, is a diagrammatic plan view showing an example of the construction of the image forming material according to the present invention.

The principle of image formation constituting the premises of the present invention is hereinafter explained. A photosensitive material uniformly charged to a positive or a negative polarity is exposed to a laser beam, depending on the picture information, to selectively eliminate electrical charges so as to form an electrostatic latent image. A developer containing colorant particles charged to the opposite polarity to that of the charges on the photosensitive material is brought into contact with the photosensitive material for selective deposition and fixation of the colorant particles.

It is therefore required of the photosensitive base material to contain the photosensitive material as a component. An organic or inorganic photosensitive material may be used as such a photosensitive material. The organic photosensitive material, for example, may be selected from a wide range of known materials exemplified by a photosensitive material for electrophotography consisting of poly-N-vinyl carbazole and 2,4,7-trinitrofluorene-9-on, a material formed by intensifying poly-N-vinylcarbazole with pyrylium salt base dyestuffs, a material formed by intensifying poly-N-vinylcarbazole with cyanin dyestuff, a photosensitive material for electrophotography consisting essentially of an organic pigment such as phthalocyanin or a photosensitive material for electrophotography consisting essentially of an eutectic complex of a dyestuff and a resin. An inorganic photosensitive material may be exemplified by zinc oxide, zinc sulfide, cadmium sulfide, selenium, selenium-tellurium alloys, selenium-arsenic alloys, selenium-tellurium-arsenic alloys or an amorphous silicon base material. These may be dispersed in suitable resins, such as silicon resin, acrylic resin or alkyd resin.

The above photosensitive material is usually formed as a thin film, so that it may be conveniently laminated on a tough or resilient supporting material. An electrode layer for allowing selective charge leakage at the time of exposure to a laser beam as later described is previously formed on the supporting material. When, above all, the light exposure is performed from the side of the supporting material, the laser beam must pass through both the supporting material and the electrode layer before reaching the photosensitive material, so that it is required of the supporting material and the electrode layer to have sufficient permeability to the laser beam at the working wavelength.

A transparent film may also be laminated on the developing surface of the photosensitive material and an image may be formed on this transparent film which may then be peeled off from the photosensitive material. In such case, the photosensitive material may be tinted in advance to allow the extent of selection of the photosensitive material to be widened.

On the other hand, the developer employed in the present invention is an electrically insulating organic material which is solid at ambient temperature and in which are dispersed colorant particles.

The electrically insulating organic material solid at ambient temperatures includes paraffins, waxes and mixtures thereof. The paraffins include normal paraffins from nonadecane to hexacontane having 19 to 60 carbon atoms. The waxes include vegetable waxes, such as carnauba wax or cotton wax, animal waxes such as bees wax, ozokerite, and petroleum waxes, such as paraffin wax, crystallite wax or petrolatum. These materials are dielectrics having the dielectric constant $\epsilon$ at 20° C. of the order of 1.9 to 2.3. Besides the above dielectrics, crystalline high molecular materials having long alkyl groups in the side chain, such as polyethylene, polyacrylamide, poly-n-stearyl acrylate, homopolymers of polyacrylates or copolymers of polyacrylates, may be employed.

The colorants dispersed in the above mentioned electrically insulating organic material may be any of the known organic pigments, inorganic pigments, dyestuffs or mixtures thereof. For example, the inorganic pigments may include chromium pigments, cadmium pigments, ferrous pigments, cobaltous pigments, ultramarine and Berlin blue. The organic pigments or dyestuffs include Hansa Yellow (C.I. 11680), Benzidine Yellow G (C.I. 21090), Benzidine Orange C.I. 21110), Fast Red (C.I. 37085 , Brilliant Carmine 3B (C.I. 16015-Cake), Phthalocyanine Blue (C.I. 74160), Victoria Blue (C.I. 42595-make), Spirit Black (C.I. 50415), Oil Blue (C.I. 74350), Alkali Blue (C.I. 42770A), Fast Scarlet (C.I. 12315), Rhodamine 6B (C.I. 45160), Rhodamine Lake (C.I. 45160-Lake), Fast Sky Blue (C.I. 74200-Lake), Nigrosine (C.I. 50415) and carbon black. These colorants may be used singly or in combination, or those exhibiting desired coloring may be used selectively.

The developer of the present invention may include resins, in addition to the aforementioned electrically insulating organic materials and colorants, for the purpose of interengaging with the colorant particles for improving dispersibility and facilitating fetching of charge donors as later described for increasing the amount of charges as well as promoting fixation of the colorants. These resins may be those known per se and include rubbers such as butadiene rubber, styrene-butadiene rubber, syclicized rubber or natural rubber, synthetic resins, such as styrene resin, vinyl toluene resin, acrylic resin, methacrylic resin, polyester resin, polycarbonate resin or polyvinyl acetate resin, modified alkyd containing alkyd resins including rosin resin, hydrogenated rosin resin or linseed oil modified alkyd resin, and natural resins, such as polyterpenes. Photo resin modified phenol resins such as phenol formalin resins, pentaerythrite phthalate, coumarone-indene resins, ester gum resins or vegetable oil polyamide resins, may also be employed. In addition, halogenated hydrocarbon polymers, such as polyvinyl chloride or chlorinated polypropylene, synthetic rubbers, such as vinyl toluene-butadiene or butadiene-isoprene, polymers of acrylic monomers having long-chain alkyl groups, such as 2-ethylhexyl methacrylate, lauryl methacrylate, stearyl methacrylate, lauryl acrylate or octyl acrylate, copolymers thereof with other polymerizable monomers, such as styrene-lauryl methacrylate copolymers or acrylic acid-lauryl methacrylate copolymers, polyolefins such as polyethylene or polyterpenes, may also be employed.

Charge donors are added to the developer, according to the accepted practice. The charge donors include salts of fatty acids, such as naphthenic acid, octenic acid, oleic acid, stearic acid, isostearic acid or lauric acid, metal salts of esters of sulfosuccinic acid, metal salts of oil-soluble sulfonic acid, metal salts of esters of phosphoric acid, metal salts of abietic acid, metal salts of aromatic carboxylic acid and metal salts of aromatic sulfonic acid.

For augmenting charges of colorant particles, fine particles of metal oxides, such as $SiO_2$, $Al_2O_3$, $TiO_2$, ZnO, $Ga_2O_3$, $In_2O_3$, $GeO_2$, $SnO_2$, $PbO_2$ or MgO, or mixtures thereof, may be added to the developer as the charge intensifying agents.

The colorants are usually added in an amount of 0.01 to 100 g and preferably 0.1 to 10 g to 1 liter of the electrically insulating organic material in the molten state. With the image forming material of the present invention, the electrostatic latent image need be developed with a minor amount of the developer. Thus the amount of the colorant is desirably 2 to 10 wt. % in terms of the concentration thereof to the electrically insulating organic material or the ratio of the colorant to the electrically insulating organic material (dilution ratio). This enables a high-quality image free of uneven development to be produced, while reducing the amount of the waste toner.

The resins are added in an amount equal to or less than the colorant and in an amount preferably 0.01 to 100 g and more preferably 0.1 to 10 g to 1 liter of the electrically insulating organic material in the liquefied and molten state.

The charge donors are added in an amount usually of 0.001 to 10 g and preferably of 0.01 to 1 g to 1 liter of the electrically insulating organic material in the liquefied and molten state. The charge intensifying agent is added in an amount by weight ratio of not more than twice that of the colorant and preferably not more than the amount of the colorant.

With the above developer, the charges on the colorant particles are preferably $1\times10^{-4}$ to $15\times10^{-4}$ coulomb/g, while the concentration of excess ions in the developer is preferably $1\times10^{7}$ to $3\times10^{-7}$ coulomb/ml. This is to take account of the phenomenon proper to development in which the amount of charges on the colorant particles less than $1\times10^{-4}$ coulomb/g gives rise to toner flow or image bleeding and, conversely, the amount of charges on the colorant particles in excess of $15\times10^{-4}$ coulomb/g gives rise to insufficient developing concentration. An excess ion concentration less than $1\times10^{7}$ coulomb/ml imparts a "hard" feel to the image, whereas the excess ion concentration higher than $3\times10^{-7}$ coulomb/ml gives rise to toner flow or insufficient development concentration.

The amount of the charge on the colorant may be adjusted by suitably selecting the kinds and the amounts of addition of the above mentioned resins, charge donors or the charge intensifying agents. On the other hand, the excess ion concentration may be adjusted by addition of alkali metal salts, such as lithium dioctylsulfosuccinate, sodium dioctylsulfosuccinate or potassium dioctylsulfosuccinate.

During development, the developer is in the heated and molten state. The heating temperature at this time may be suitably set in dependence upon the melting point, for example, of the electrically insulating material, and is usually in the range from 30° to 130° C. and preferably from 40° to 110° C.

The image forming material of the present invention consists of a container for the developer and a photosensitive base unified with the developer container. Although there is no specific limitation to the construction of the image forming material, a typical construction may include a photosensitive base secured at the center of a suitable frame and the developer container enclosed in the frame as a thin pouch-like section. That portion of the developer container facing the photosensitive base material may be basically opened because the developer employed in accordance with the present invention is solid at ambient temperature and hence is not susceptible to leakage unless it is heated before development to higher than the melting point of the electrically insulating organic material, or subjected to an excess external force. However, the portion is desirably sealed off to assure higher safety in handling and to prevent color mixing when a plurality of color developers are used. Such a seal is formed of a material the strength of which is so selected that the developer may be contained before development and may be easily disrupted during development as a result of pressure application to discharge the developer onto the surface of the photosensitive base.

According to the present invention, a single color image may be formed by using only one developer contained in the container, while a multicolor image may also be formed by using two or more developers of different colors in two or more developer containers. For example, a full-color image may be formed when the developer of three colors of cyan, Yellow or magenta are contained in separate developer containers, and the operation of forming an electrostatic image and developing the electrostatic image by the discharged developers is repeated for each color. If inking is to be performed at a suitable stage, a black-tinted developer may be accommodated in the dedicated developer container.

In general instant photography, an image is formed in accordance with a chemical process in which the coloring matter is destroyed or diffused by the redox reaction in accordance with the developed halide image. Thus, even when the developer remains coated on the overall surface of the latent image forming surface, the image can be perceived because coloration by the chemical reaction occurs only at prescribed sites. However, the image formation in accordance with the present invention occurs on the basis of electrostatic adsorption of the colorant particles at the electrically charged sites on the photosensitive member. Hence, the image recognition is not possible until a sufficient amount of the developer is contacted with the overall surface of the latent image forming surface to effect necessary adsorption and the redundant developer is then removed. Thus, in accordance with the present invention, it is desirable to provide a space for recovery of the redundant developer in addition to the aforementioned developer container.

The above described image forming material of the present invention, inclusive of the photosensitive member, the developer container and the space for recovery of the developer, is preferably of such a size and a shape pursuant to a 35 mm format slide size (2×2 slide size with the picture dimension of 22.5 mm×34.3 mm) prescribed by JIS B7163. In this case, the image forming material of the present invention may be directly mounted to a slide projector without handling difficulties. However, only the size in the plan configuration of the material may be made pursuant to the 35 mm format slide size on the condition that the thickness after the photosensitive base is peeled from the developer container or from the space for recovery of the excess developer coincides with that of accommodating space in the slide projector. The photosensitive bases may also be separated from the developer container or the space for recovery of the excess container and the outer shape and size of the thus separate photosensitive base may be made to coincide with the 35 mm slide size.

As may be seen from the foregoing description, it is possible with the image forming material of the present invention to handle the photosensitive base and the developer simultaneously, so that the image forming time may be shortened significantly. The reproducibility in image formation may also be improved through prevention of temporal changes in the developer composition. In addition, the construction and the maintenance of the apparatus necessary for image formation may also be facilitated. As a result, a high quality image having superior resolution and gradation comparable with that attained with the halide photograph may be produced easily.

The outer size and shape of the image forming material or that of the separated photosensitive base is of the 35 mm format slide size so that the image forming material or the base member can be handled in the same way as the conventional 35 mm format slide and may be directly attached to, for example, a slide projector.

A preferred embodiment of the present invention is hereinafter explained by referring to the drawings.

FIG. 1 shows a typical construction of the image forming material of the present invention.

An image forming material A is formed by a photosensitive base 2 secured to a frame 1. A magenta developer container 3 is enclosed within the interior of the frame 1. A cyan developer container 4, a yellow developer container 5 and a section 6 are provided for recovery of a redundant developer. A full-color image is produced by the color substraction method.

Figure 2:
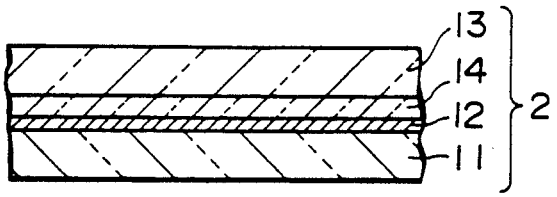
FIG. 2 is an enlarged cross-sectional view showing essential parts of the photosensitive base.

As shown in cross-section in FIG. 2, the photosensitive base 2 includes a supporting sheet 11 of a 2 μm thick polyethylene terephthalate film on which are sequentially superimposed a transparent electrode layer 12 of 2 μm thick indium-tin oxide (ITO), an intermediate layer 14 of a 2 μm thick modified vinyl acetate resin and an 8 μm thick photosensitive layer 13 containing 1 g of polyvinyl carbazole as a sensitizer agent and 2 mg of a cyanine dyestuff, manufactured by the Japanese Research Institute For Photosensitizing Dyes Co. Ltd. KK under the trade name of NK 2892, as an intensifier.

From the containers 3, 4 and 5 are led out channels 3*a*, 4*a* and 5*a* for conducting the developer to one end of the photosensitive base 2. The terminal ends 3*b*, 4*b* and 5*b* of these channels 3*a*, 4*a* and 5*a* are sealed with a material which may be easily disrupted to release the developer upon pressing the containers 3, 4 and 5 with a predetermined pressure.

The magenta, cyan and yellow developers contained in the containers 3, 4 and 5, have been prepared in the following manner.

MAGENTA DEVELOPER 0.8 g of Simular Rhodamine Y Toner F as the coloring agent, manufactured by the Dainippon Ink & Chemicals Inc. was kneaded, along with 0.5 g of linseed oil, to a paste-like product, in accordance with the Fouver-Maler process. The size of the coloring agent was thus reduced. This paste was dispersed in 50 ml of an isoparaffin manufactured by ESSO under the trade name of Isopar H, and subjected to dispersion for 18 hours in a paint shaker along with glass beads. Then, 0.5 g of a 50% - toluene solution of an acrylic resin manufactured by the Mitsubishi Rayon Co. Ltd. under the trade name of FR 101, 0.025 g of zirconium naphthenate and 0.025 g of calcium naphthenate as the charge donor were added to the dispersion to produce a concentrated liquid developer. Then, 120 ml of paraffin melting at 42° to 44° C. was melted at 70° C. in advance, and 5 ml of the above concentrated liquid developer was dispersed thereinto to produce a magneto-tinted developer.

CYAN DEVELOPER 0.625 g of Lionol Blue KX-F1 manufactured by Toyo Ink Co. Ltd., as the coloring agent, and 0.5 g of an isoparaffin manufactured by Idemitsu Sekiyu Co. Ltd. under the trade name of IP 2825, were kneaded to a paste-like product by the Fouver-Maler method. The size of the coloring agent was reduced. This paste was dispersed in 50 ml of a separate isoparaffin manufactured by ESSO under the trade name of Isopar H. Then, fine particles of alumina, manufactured by the Nippon Aerosil Co. Ltd. under the trade name of Aluminum Oxide C, as the charge intensifier, were added to the dispersion, and a dispersing operation was performed in a paint shaker for 12 hours along with alumina beads. The method for preparing the concentrated liquid developer and the electrostatic latent image developer is the same as that described above for the magenta developer.

YELLOW DEVELOPER 0.5 g of Similar Fast Yellow 8GF, as the coloring agent, manufactured by Dainippon Ink & Chemicals Inc. and an isoparaffinic, manufactured by Idemitsu Sekiyu Co. Ltd. under the trade name of IP 2825, were kneaded by the Fouver-Maler process to a paste-like product and the coloring agent was thereby reduced in size. This paste was then dispersed in 50 ml of a separate isoparaffin, manufactured by ESSO under the trade name of Isopar H. 0.01 g of an ultra fine anhydrous silica manufactured by Nippon Aerosil Co. Ltd. under the trade name of Aerosil 200 was added as a charge intensifier. The resulting mass was subjected to dispersion in a paint shaker for 18 hours along with glass beads. The method for preparing the concentrated liquid developer and the electrostatic latent image developer is the same as that for the magenta developer described above.

The developer recovery section 6 has its terminal end 6*b* opened in advance for facing the photosensitive base 2 for sucking an excess developer thereat for storage in the recovery section 6. It is preferred for the opened position of the terminal end 6*b* to be as far from the terminal ends 3*b*, 4*b* and 5*b* of the developer containers 3, 4 and 5 as possible for the purpose of recovering the developer after allowing the developer to contact sufficiently with the photosensitive base 2. With the image forming material A shown in FIG. 1, the terminal ends 4*b* and 6*b* are arranged on a diagonal line on the photosensitive base 2.

With the above described image forming material, the size of the frame 1 and the size of an effective picture surface of the photosensitive base 2 are of the 35 mm format slide size prescribed in JIS as described above. Hence, the image forming material may be directly handled as the 35 mm format slide, similarly to the slide prepared by the well-known photographic technique, and may be directly projected by a general-purpose slide projector.

Perforations may be provided along the perimeter of the frame 1 corresponding to the outer periphery of the photosensitive base 2, or along the perimeter of the photosensitive base 2 itself. By such a technique an image can be cut off easily after its formation with increased convenience in storage. It is, however, necessary in this case that the size of the photosensitive base after cutting off the image be of the aforementioned 35 mm format slide size.

The sequence of actually forming the image using the image forming material of the present invention is explained by referring to FIGS. 3A to 3D.

Figure 3A:
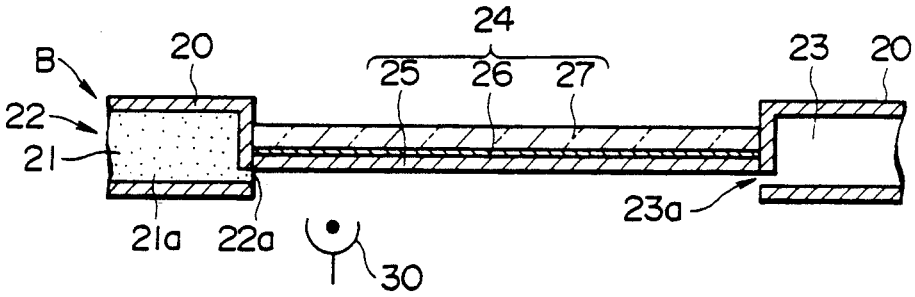

Referring first to FIG. 3A, the frame 20 of the image forming material B is loaded on an image forming apparatus, not shown, by suitable fastening means, also not shown. Within the interior of the frame 20, a container 22 for accommodating a developer 21 containing colorant particles 21*a* and a developer recovery section 23 are provided. The container 22 and the recovery section 23 are provided with openings 22*a*, 23*a* on the sites facing the photosensitive base 24. The opening 23*a* of the recovery section 23 is literally opened from the outset, whereas the opening 22*a* of the developer container 22 is sealed with a thin film or the like prior to development. The developer 21 needs to be maintained at a temperature which is at least higher than the melting point of the electrically insulating organic material by suitable heating means, not shown, prior to development.

The photosensitive base 24 is formed by a photosensitive layer 25, a transparent electrode layer 26 and a supporting sheet 27, laminated one upon the other. Although the image forming material B is loaded in FIG. 3A with the supporting sheet 27 and the photosensitive layer 25 facing upward and downward, respectively, the loading direction may naturally be reversed.

The operational sequence of forming an electrostatic latent image using the above described image forming material is hereinafter explained.

The photosensitive layer 25 is uniformly charged to, for example, −700 V, by scanning of a corona discharge member from the side of the photosensitive layer 25.

Figure 3B:
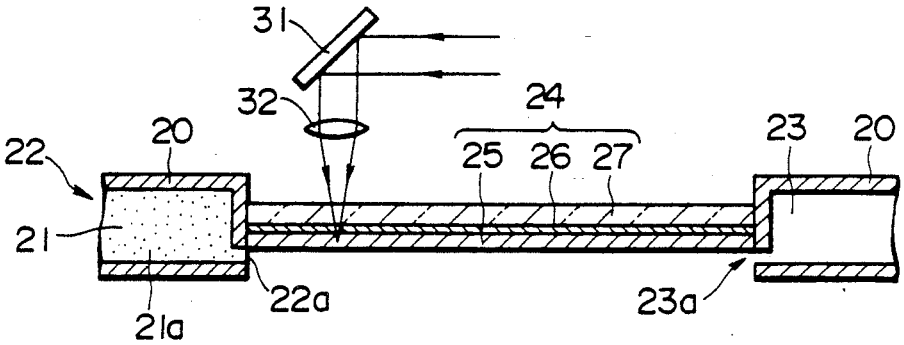

Then, as shown in FIG. 3B, selective light exposure is performed from the supporting sheet 27 in accordance with picture data with the use of a suitable optical system having a reflective mirror 31 and a lens 32. The minus charges are leaked at the exposed sites through the transparent electrode layer 26, and are rendered electrically neutral to form an electrostatic latent image. The light exposure may also be made from the side of the photosensitive layer 25. At any rate, a suitable image data processing method needs to be selected by taking into account from which of the sides of the supporting sheet 27 or the photosensitive layer 25 the aesthetic appreciation of the ultimate image is to be made.

Figure 3C:
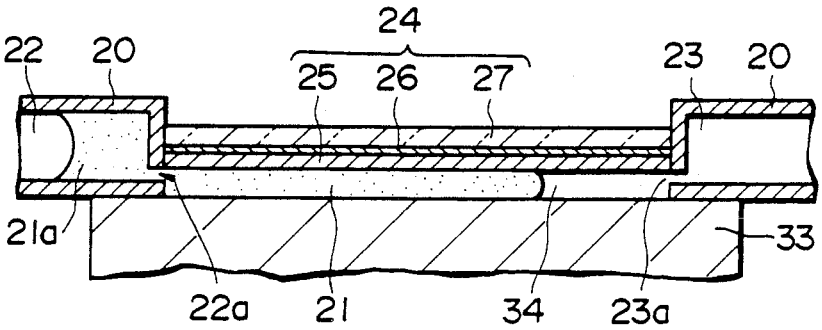

Then, as shown in FIG. 3C, a bias electrode 33 having a surface area large enough to cover the surface of the photosensitive base 24 is brought into abutment with the frame 20 from the side of the photosensitive layer 25 of the image forming material B. Since the frame 20 of the image forming material B has a larger thickness than that of the photosensitive base 24, a gap of a reduced thickness 34 is procured between the photosensitive layer 25 and the bias electrode 33 supported on the frame 20. The bias electrode 33 is maintained at a potential such as −400 V, which is high enough to erase the residual potential not taking part in the image formation. In this state, the developer container 22 is pressed by suitable pressing means, not shown, to disrupt the thin film, not shown, which has sealed the opening 22*a*, to release the developer 21 towards the gap 34. When the developer 25 contacts the photosensitive layer 25 in this manner, colorant particles 21*a*, which have been dispersed in the developer 21 and charged to the positive polarity, are selectively affixed on the sites of the photosensitive layer 25 where the negative charges are left to develop the electrostatic latent image.

Figure 3D:
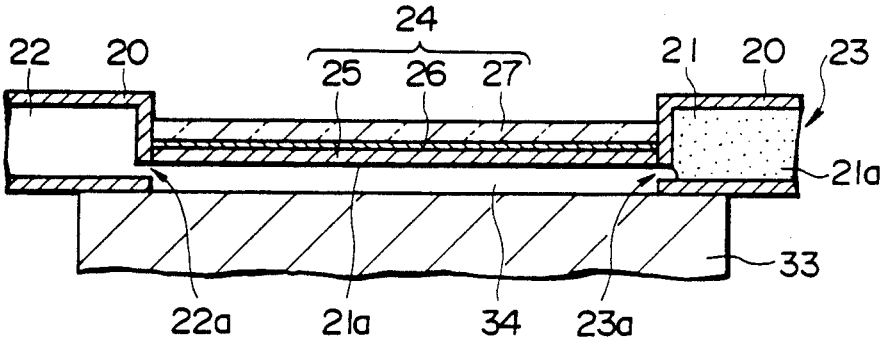

Finally, as shown in FIG. 3D, the developer container 22 is further pressed to discharge the excess developer 21 into the recovery section 23 by way of the opening 23*a*. In this manner, the image on which colorant particles 21*a* are selectively affixed comes to be perceived. For more effective discharging, air or the like may be pumped from the developer supplying end or sucked from the discharging end.

In the above described fundamental operational sequence, fixation or charge removal operations may also be performed in case of necessity.

A full-color image may also be formed by using magenta, cyan and yellow developers and repeating the steps from FIGS. 3B to 3D for each color. The development sequence may be selected depending on the kind of the light source employed for sensitization. When an IR laser is used, for example, the development sequence is yellow-magenta-cyan and, when a UV laser is used, the development sequence is cyan-magenta-yellow. Inking may also be performed in black at a suitable point during development for each color.

Each operation shown in FIGS. 3A to 3D may be performed at a point on the stationary image forming material or at plural points with the moving image forming material B.

Figure 4B:
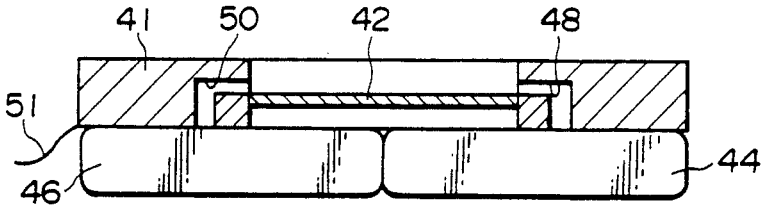
FIG. 4B is a diagrammatic cross-sectional view of the image forming material shown in FIG. 4A.
Figure 4A:
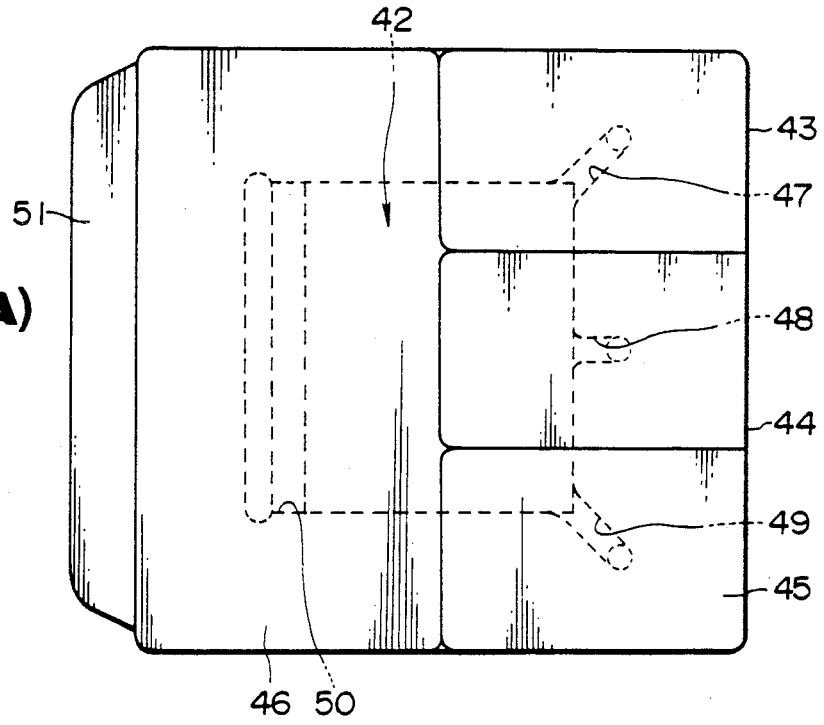
FIG. 4A is a diagrammatic plan view showing an example of an image forming material with the developer container and the developer recovery section provided on the reverse side of the photosensitive base.

In the above described embodiment, the overall size of the frame 1, photosensitive base 2, developer containers 3, 4 and 5 and the developer recovery section 6 is of the 35 mm format slide size. However, as shown for example in FIGS. 4A and 4B, the size in the plane configuration of the base 42 secured to the frame 41 may be of the 35 mm format slide size and the developer containers 43, 44 and 45 and the developer recovery section 46 may be mounted on the back side of the photosensitive base 42 secured to the frame 41.

The terminal ends of the developer containers 43, 44 and 45 communicate with the base 42 by way of openings 47, 48 and 49, and an opening 50 is provided for conducting the used developer towards the developer recovery section 46, as is the preceding embodiment.

Figure 4C:
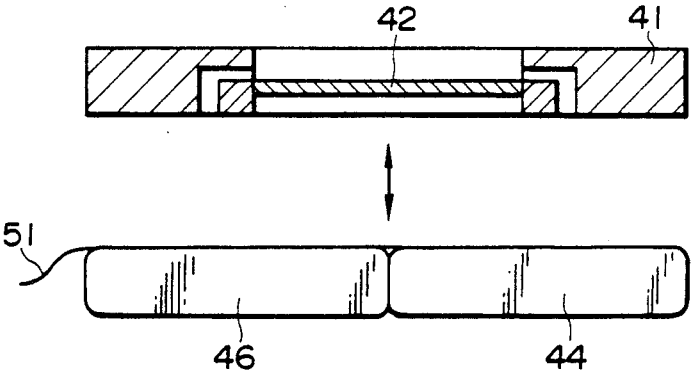
FIG. 4C is a diagrammatic cross-sectional view showing the separated state.

With the above described image forming material, the photosensitive base 42 secured to the frame 41 are bonded with an adhesive with a weak adhesive power to the developer containers 43 to 45 and the recovery section 46, and a releasing tongue 51 is provided therebetween. After the development is terminated, the tongue 51 may be gripped and pulled to peel the containers 43 to 45 and the recovery section 46 from the photosensitive base 42, as shown in FIG. 4C.

Although the overall thickness is increased slightly, the image forming material may be handled as a 35 mm format slide after termination of the developing operation.

Figure 5:
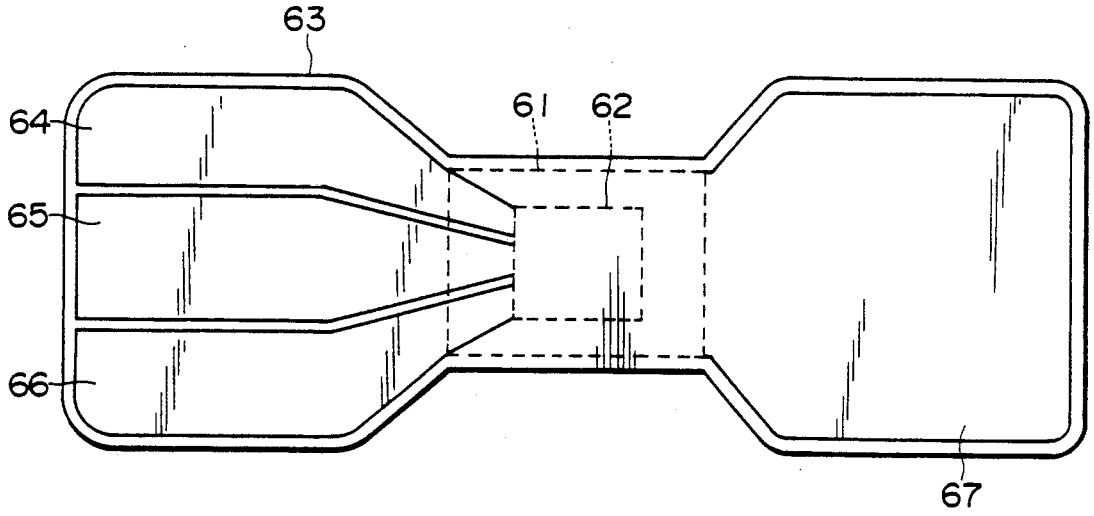
FIGS. 5 and 6 are diagrammatic plan views showing examples of the image forming material having optical shapes and in which the photosensitive base may be detached from the developer container.
Figure 6:
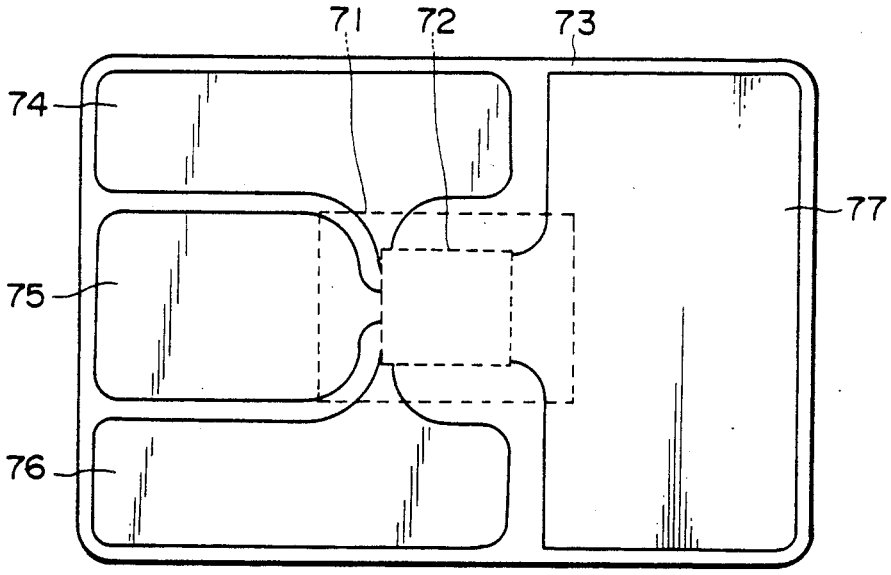

Alternately, as shown in FIGS. 5 and 6, the overall size may be optionally set and the photosensitive base may be adapted to be separable along with the frame, with the size only of the photosensitive base inclusive of the frame being of the 35 mm format slide size.

Referring to FIG. 5, a pair of wings 63 are provided for extending pronouncedly from both sides of a photosensitive base 62 maintained by a frame 61, and developer containers 64 to 66 are provided at one of the wings 63 while a developer recovery section 67 is provided at the other wing 63.

In the present modification, the perimeter of the centrally disposed photosensitive base 62 is approximately 35 mm format size and, after development, the photosensitive base 62 held by the frame 61 is peeled from the wings 63 or cut along weakening lines, such as perforations.

FIG. 6 shows another modification in which a photosensitive base 72 held by a frame 71 is held by another frame 73 similar in shape to and larger in size than the frame 71. Developer containers 74 to 76 and a developer recovery section 77 are provided in the frame 73.

The photosensitive base 72 held by the frame 71 is similar to of the 35 mm format slide size, and may be separated after development from the frame 73.

Figure 7:
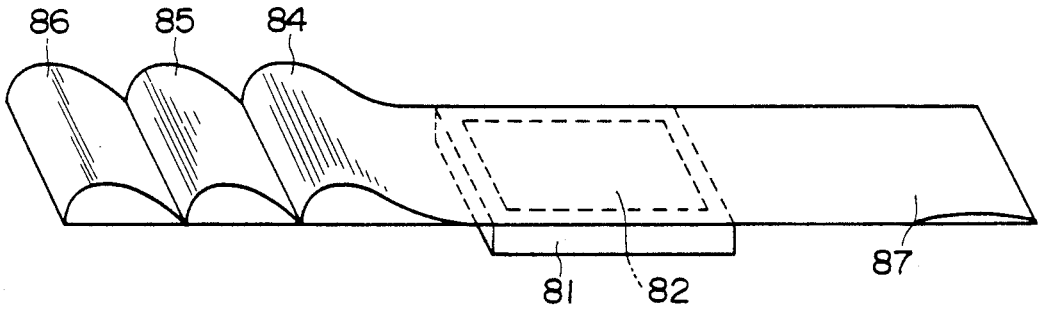
FIG. 7 is a diagrammatic perspective view showing an example of the image forming material in which the photosensitive base, the developer container and the developer recovery section are arranged in tandem.

FIG. 7 shows a further modification in which a photosensitive base 82 held by a frame 81 is of the 35 mm format slide size and bonded to an elongated sheet 83 and in which developer containers 84 to 86 and a developer recovery section 87 are arranged in tandem.

Figure 8A:
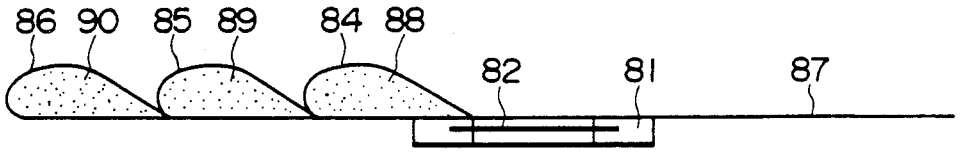
FIGS. 8A to 8D are diagrammatic cross-sectional views showing the sequential steps in the developing process.
Figure 8B:
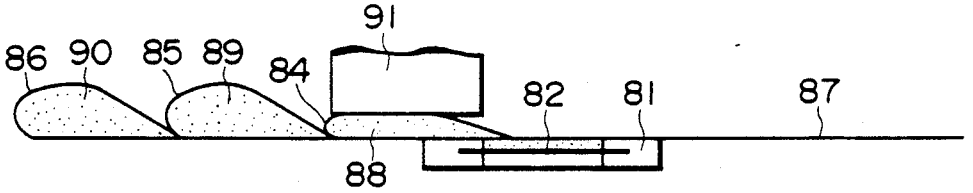
Figure 8C:
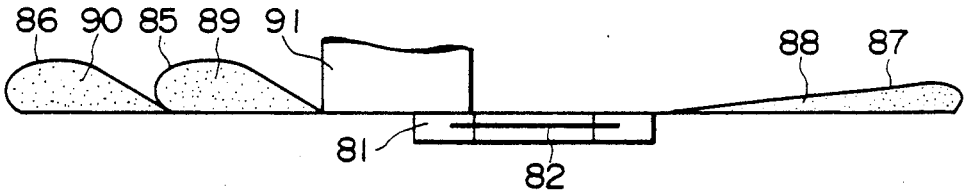
Figure 8D:
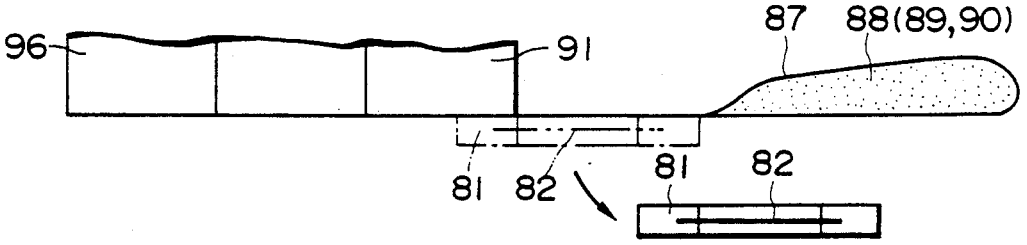

The image forming material is developed by a process shown in FIGS. 8A to 8D and ultimately a photosensitive base 82 held on the frame 81 is peeled from the sheet 83 to form a 35 mm format slide. Referring to FIG. 8A, a yellow developer 88, a magenta developer 89, and a cyan developer 90 are accommodated in the developer containers 84 to 86. As shown in FIG. 8B, the container 84 containing the yellow color is heat-pressed by a press 91. This causes the yellow-tinted developer 88 in the container 84 to be introduced onto the photosensitive base 82 to develop the electrostatic latent image formed on the base 82. The used developer is conducted to the recovery section 87 as shown in FIG. 8C.

After the similar operation is carried out for each of the three colors, the photosensitive base 82 held by the frame 81 is peeled from the sheet to provide a 35 mm format slide.

Although the present invention has been described with reference to preferred embodiment thereof, it is to be clearly understood that these embodiments are given only by way of examples and illustration and are not to be taken in a limiting sense, the spirit and the scope of the invention being limited only by the terms of the appended claims.

What is claimed is:

1. An image forming material, comprising:

a photosensitive base on which an electrostatic latent image is formed in correspondence with an image information;

a developer container formed integrally with said base and containing a developer composed of colorant particles charged to an opposite polarity to said latent image and dispersed in an electrically insulating organic material which is solid at ambient temperature and which is changed between a solid state and a liquid state on heating and cooling; and an area of the photosensitive base being dimensioned and image characteristics of the photosensitive base being designed for direct use of the electrostatic latent image after developing with said developer without transfer to another medium.

2. The image forming material according to claim 1 wherein a recovering section for recovering used developer is also formed integrally with said base.

3. The image forming material according to claim 1 comprising a plurality of the developer containers.

4. The image forming material according to claim 3 wherein cyan, yellow and magenta developers are separately accommodated in the developer containers.

5. The image forming material according to claim 1 wherein the photosensitive base is secured to a frame and the developer container is provided in said frame.

6. The image forming material according to claim 1 comprising a channel for routing the developer from the developer container towards one end of the photosensitive base.

7. The image forming material according to claim 1 wherein the electrically insulating organic material is an element selected from the group consisting of paraffins, waxes or mixtures thereof.

8. The image forming material according to claim 1 wherein said photosensitive base consists of a supporting sheet, a transparent electrode, an intermediate layer and a photosensitive layer laminated together.

9. The image forming material according to claim 1 wherein a dielectric constant at 20° C. of the electrically insulating organic material is 1.9 to 2.3.

10. The image forming material according to claim 1 wherein the colorant particles are dispersed at a rate of 0.01 to 100 g to 1 liter of the electrically insulating organic material.

11. The image forming material according to claim 1 wherein a concentration of the colorant particles in the organic material is 2 to 10 percent by weight.

12. The image forming material according to claim 1 wherein charges on the colorant particles are $1\times10^{-4}$ to $15\times10^{-4}$ coulomb/g.

13. The image forming material according to claim 1 wherein a concentration of excess ions in the developer is $1\times10^{-7}$ to $3\times10^{-7}$ coulomb/ml.

14. The image forming material according to claim 1 having a size of a 35 mm format slide size.

15. An image forming material, comprising:

a photosensitive base on which an electrostatic latent image is formed in correspondence with an image information;

a developer container formed integrally with said base and containing a developer composed of colorant particles charged to an opposite polarity to said latent image and dispersed in an electrically insulating organic material which is solid at ambient temperature and which is changed between a solid state and a liquid state on heating and cooling; and separating means for cutting off the photosensitive base.

16. The image forming material according to claim 15 wherein a size of a separated photosensitive base is of the 35 mm format slide size.

17. An image forming material, comprising:

a photosensitive base on which an electrostatic latent image is formed in correspondence with an image information;

a developer container formed integrally with said base at one side of said photosensitive base and containing a developer composed of colorant particles charged to an opposite polarity to said latent image and dispersed in an electrically insulating organic material which is solid at ambient temperature and which is changed between a solid state and a liquid state on heating and cooling;

said developer container having a communicating channel with said photosensitive base at said one side; and a recovery section container at an opposite side of said base and formed integrally with said base.

18. The image forming material according to claim 17 wherein three of said developer containers are provided, each for particles of a different colorant, and each having channels for communicating with said one side of said photosensitive base.

19. The image forming material according to claim 17 wherein an area and image characteristics of said photosensitive base being dimensioned for direct use of the electrostatic latent image after developing with said developer without transfer to another medium.

* * * * *